US011837374B2

(12) United States Patent
Corbin et al.

(10) Patent No.: US 11,837,374 B2
(45) Date of Patent: Dec. 5, 2023

(54) ZAMAK STABILIZATION OF SPENT SODIUM-COOLED REACTOR FUEL ASSEMBLIES

(71) Applicant: TerraPower, LLC, Bellevue, WA (US)

(72) Inventors: Robert A. Corbin, North Bend, WA (US); Pavel Hejzlar, Kirkland, WA (US); John E. Truax, Bellevue, WA (US); Mark R. Werner, Bellevue, WA (US)

(73) Assignee: TerraPower, LLC, Bellevue, WA (US)

( * ) Notice: Subject to any disclaimer, the term of this patent is extended or adjusted under 35 U.S.C. 154(b) by 266 days.

(21) Appl. No.: 17/230,182

(22) Filed: Apr. 14, 2021

(65) Prior Publication Data

US 2022/0336118 A1 Oct. 20, 2022

(51) Int. Cl.
*G21F 9/20* (2006.01)
*G21F 9/30* (2006.01)
(Continued)

(52) U.S. Cl.
CPC ..... *G21F 9/308* (2013.01); *C22C 18/04* (2013.01); *G21C 19/32* (2013.01); *G21F 1/085* (2013.01);
(Continued)

(58) Field of Classification Search
CPC . G21F 1/085; G21F 5/008; G21F 5/10; G21F 9/30; G21F 9/302; G21F 9/308; G21F 9/20; G21C 3/54; G21C 1/02
See application file for complete search history.

(56) References Cited

U.S. PATENT DOCUMENTS 10,685,753 B1 * 6/2020 Baer ..... G21C 19/44
2013/0083878 A1 * 4/2013 Massie ..... G21C 3/54 376/458

(Continued)

FOREIGN PATENT DOCUMENTS

DE 2911185 A1 10/1980
WO WO-2022177862 A1 * 8/2022

OTHER PUBLICATIONS

Park, Yongsoo, Thomas J. McKrell, and Michael J. Driscoll. "Heat transfer enhancement for spent nuclear fuel assembly disposal packages using metallic void fillers: A prevention technique for solidification shrinkage-induced interfacial gaps." Journal of Nuclear Materials 489 (2017): 196-202. (Year: 2017).*

(Continued)

*Primary Examiner* — Lily C Garner
(74) *Attorney, Agent, or Firm* — Merchant and Gould, PC

(57) ABSTRACT

Methods and systems for stabilizing spent fuel assemblies from sodium-cooled nuclear reactors using Zamak are described herein. It has been determined that there is a synergism between Zamak and sodium that allows Zamak to form thermally-conductive interface with the sodium-wetted surfaces of the fuel assemblies. In the method, one or more spent fuel assemblies are removed from the sodium coolant pool and placed in a protective sheath. The remaining volume of the sheath is then filled with liquid Zamak. To a certain extent Zamak will dissolve and alloy with sodium remaining on the fuel assemblies. Excess sodium that remains undissolved is displaced from the sheath by the Zamak fill. The Zamak is then cooled until solid and the sheath sealed. The resulting Zamak-stabilized spent fuel assembly is calculated to have sufficient internal thermal conductivity to allow it to be stored and transported without the need for liquid cooling.

19 Claims, 6 Drawing Sheets

(51) Int. Cl.

| | |
|---|---|
| ***C22C 18/04*** | (2006.01) |
| ***G21F 1/08*** | (2006.01) |
| ***G21C 19/32*** | (2006.01) |
| *G21F 5/008* | (2006.01) |
| *G21F 5/10* | (2006.01) |
| *G21C 1/02* | (2006.01) |

(52) U.S. Cl.
CPC ..... *G21F 9/302* (2013.01); *G21C 1/02* (2013.01); *G21F 5/008* (2013.01); *G21F 5/10* (2013.01); *G21F 9/20* (2013.01)

(56) References Cited

U.S. PATENT DOCUMENTS

| | | | | |
|---|---|---|---|---|
| 2020/0273591 | A1* | 8/2020 | Muller | G21F 9/36 |
| 2023/0106712 | A1* | 4/2023 | Pantano | G21C 15/26 376/299 |
| 2023/0197301 | A1* | 6/2023 | Pouvreau | G21C 15/26 376/282 |

OTHER PUBLICATIONS

Park, Yongsoo. Improving heat transfer in spent nuclear fuel disposal packages using metallic void fillers. Diss. Massachusetts Institute of Technology, 2016. (Year: 2016).*

Mathew, P. M., et al. "Filler metals for containers holding irradiated fuel bundles." Metals Technology 9.1 (1982): 375-380. (Year: 1982).*

Park, Heat Transfer Enhancement for Spent Nuclear Fuel Assembly Disposal Packages Using Metallic Void Fillers: A Prevention Technique for Solidification Shrinkage-Induced Interfacial Gaps, The Journal of Nuclear Materials, Elsevier, Amsterdam, NL, vol. 489, Jun. 2017, pp. 196-202.

PCT/US2021/027249 ISR and WO dated Dec. 22, 2021, 17 pages.

Park, Improved heat transfer in spent nuclear fuel disposal packages using metallic void fillers, Masters Thesis submitted to the Department of Nuclear Science and Engineering, Copyright 2016 Massachusetts Institute of Technology.

Zamak Wikipedia; printed on Apr. 22, 2021.

* cited by examiner

ZAMAK STABILIZATION OF SPENT SODIUM-COOLED REACTOR FUEL ASSEMBLIES

INTRODUCTION

A method is needed for disposing of spent nuclear fuel assemblies. Spent fuel assemblies still generate heat, referred to as decay heat, as nuclear material in the assemblies continues to fission. This decay heat, if not removed, can cause the components in the fuel assembly to get unacceptably hot, potentially leading to failure of the components and release of the nuclear material and fission products within the assemblies.

To prevent overheating of spent fuel assemblies, "wet storage" is often used in which spent fuel assemblies are submerged in a large pool of water. The pool of water acts as a coolant to remove the decay heat produced by the spent fuel assemblies. However, wet storage is not a considered long term storage solution as the integrity of the pool must be maintained. "Dry storage" in which a liquid bath or other active cooling is not required is preferred for long term storage. This allows the spent fuel assemblies to be conventionally stored with a minimum of cost.

One proposed method of stabilizing spent fuel assemblies for long term dry storage is to fill the fuel assembly with a void-filling solid material. A thermally-conductive metal or metal alloy, such as lead, could be heated to above its melting point, flowed into the spent fuel assembly filling all the spaces within the fuel assembly (e.g., the channels provided for coolant flow through the fuel assembly) and then allowed to cool and solidify. Theoretically, if the metal completely filled the spent fuel assembly, the thermal conductivity of the stabilized spent fuel assembly could be sufficient to prevent the components from getting unacceptably hot by quickly transporting the decay heat to the exterior of the fuel assembly where it is dissipated to external environment by natural convection and conduction. Thus, in theory, spent fuel assemblies stabilized in this manner could be transported and stored without the need for a liquid cooling bath or other active cooling measures.

Research identified one major problem with this method, however. It was found that gaps typically form between the void-filling materials investigated and the external surfaces of components in the fuel assembly upon solidification of void-filling material. The gaps reduced the heat transfer between the fuel assembly components and the void-filling material so much as to make this method unfeasible.

Zamak Stabilization of Spent Sodium-Cooled Reactor Fuel Assemblies

Methods and systems for stabilizing spent fuel assemblies from sodium-cooled nuclear reactors using Zamak are described herein. It has been determined that there is a synergy when using Zamak and sodium that allows Zamak to form a thermally-conductive interface with the sodium-wetted surfaces of the fuel assemblies. In the method, one or more spent fuel assemblies are removed from the sodium coolant pool and placed in a protective sheath. The remaining volume of the sheath is then filled with liquid Zamak. To a certain extent Zamak will dissolve and alloy with sodium remaining on the fuel assemblies. Excess sodium that remains undissolved is displaced from the sheath by the Zamak fill. The Zamak is then cooled until solid and the sheath sealed. The resulting Zamak-stabilized spent fuel assembly is calculated to have sufficient internal thermal conductivity to allow it to be stored and transported without the need for liquid cooling.

One drawback to metal stabilization is avoided by the methods and systems described herein: gap formation. It has been determined that a major cause of the gap formation in early stabilization efforts was the existence of an oxide layer on the external surfaces of the components of the fuel assemblies. During typical reactor operation or subsequent wet storage, external surfaces of the components of fuel assemblies develop an oxide layer due to contact with water, air, or other oxygen-containing coolants. For example, it has been determined that at high temperatures an oxide layer of several micrometers can develop in only several seconds of exposure to air. The oxide layer prevents a good metallic bonding between the void-filling materials studied and the metal components of fuel assemblies. In the absence of a good metallic bond at the contact surface between the components of the fuel assemblies and the void-filling material, a gap forms at the contact surface as the liquid void-filling material solidifies.

The formation of an oxide layer on fuel assembly surfaces is prevented by the methods described herein. Unlike traditional pressurized water reactors, fuel assemblies in sodium-cooled reactors are not exposed to oxygen and the liquid sodium prevents oxide layers from forming on the fuel assemblies. By preventing subsequent exposure of spent fuel assemblies to oxygen during the process of removing the assemblies from the sodium coolant pool and filling them with Zamak, oxide layer-induced gap formation is prevented and a good metallic bond can be formed between the Zamak and the external surfaces of the fuel assemblies.

BRIEF DESCRIPTION OF DRAWINGS

Various aspects of at least one example are discussed below with reference to the accompanying figures, which are not intended to be drawn to scale. The figures are included to provide an illustration and a further understanding of the various aspects and examples, and are incorporated in and constitute a part of this specification, but are not intended as a definition of the limits of a particular example. The drawings, together with the remainder of the specification, serve to explain principles and operations of the described and claimed aspects and examples. In the figures, each identical or nearly identical component that is illustrated in various figures is represented by a like numeral. For purposes of clarity, not every component may be labeled in every figure.

DETAILED DESCRIPTION

Figure 1:
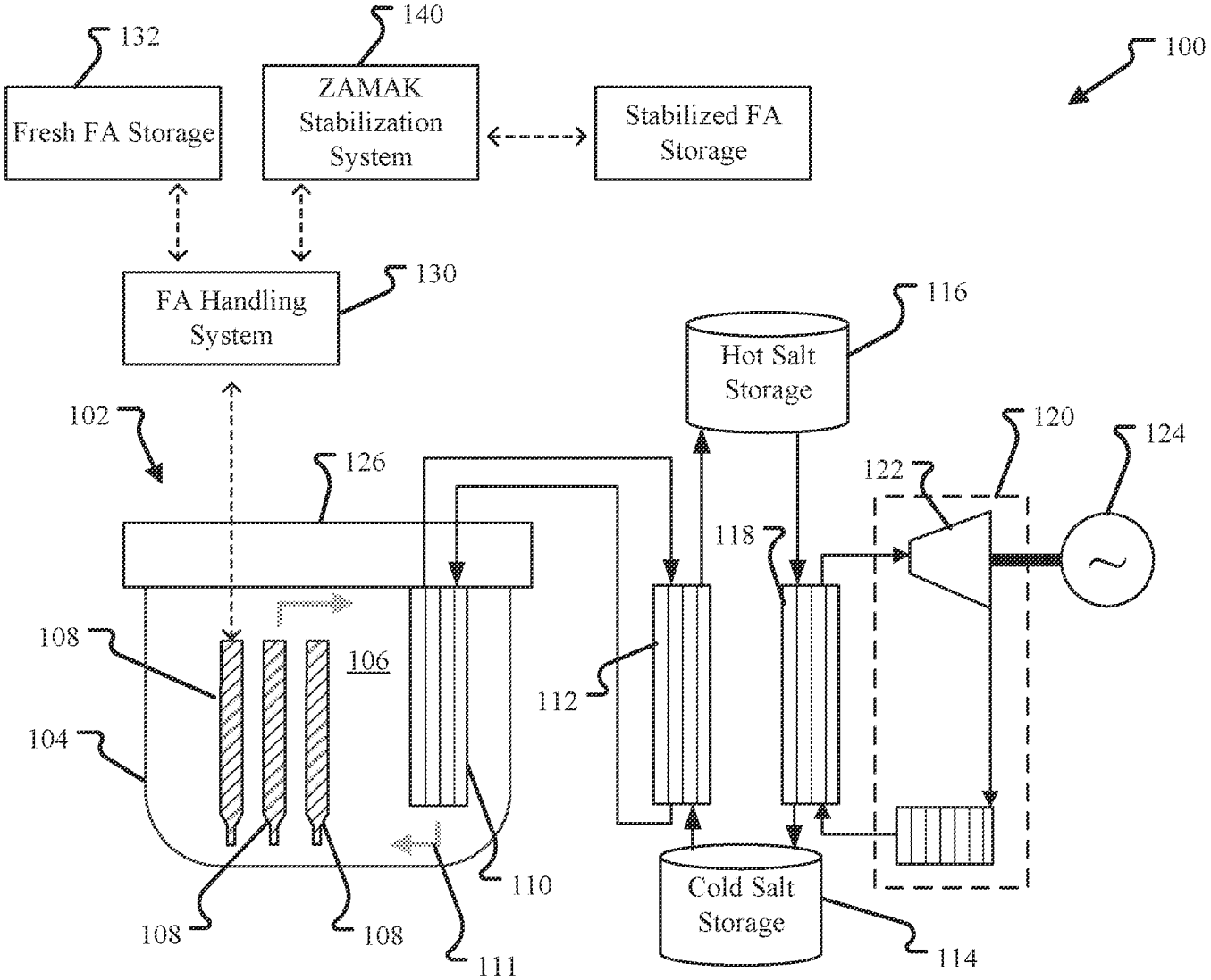
FIG. 1 illustrates an embodiment of an integrated energy system with a sodium-cooled reactor.

Before the Zamak stabilization methods and systems are disclosed and described, it is to be understood that this disclosure is not limited to the particular structures, process steps, components, or materials disclosed herein, but is extended to equivalents thereof as would be recognized by those ordinarily skilled in the relevant arts. It should also be understood that terminology employed herein is used for the purpose of describing particular embodiments of stabilizing sodium-wetted fuel assemblies only and is not intended to be limiting. It must be noted that, as used in this specification, the singular forms "a," "an," and "the" include plural referents unless the context clearly dictates otherwise. Thus, for example, reference to "a lithium hydroxide" is not to be taken as quantitatively or source limiting, reference to "a step" may include multiple steps, reference to "producing" or "products" of a reaction should not be taken to be all of the products of a reaction, and reference to "reacting" may include reference to one or more of such reaction steps. As such, the step of reacting can include multiple or repeated reaction of similar materials to produce identified reaction products.

Methods and systems for stabilizing spent fuel assemblies from sodium-cooled nuclear reactors using Zamak are described below. As mentioned above, it has been determined that there is a synergism between Zamak and sodium that allows Zamak to form thermally-conductive interface with the sodium-wetted surfaces of the fuel assemblies. To a certain extent Zamak will dissolve and alloy with sodium without reducing effectiveness of the resulting sodium-enriched Zamak as a stabilizing material. Furthermore, because the liquid Zamak is more dense than liquid sodium, any excess liquid sodium can be easily displaced and collected from the fuel assembly and sheath during the Zamak filling process.

Zamak refers to a family of alloys with a base metal of zinc and alloying elements of aluminum, magnesium, and copper. Zamak alloys are part of the zinc-aluminum alloy family and are distinguished from the other zinc-aluminum alloys by their fixed, nominal aluminum composition of 4% (effectively between 3.5 and 4.3% Al by weight). In general, Zamak has from 3.5-4.3% Al, 0.0-0.25% Cu and 0.01-0.02% Mg with the balance being Zn. For the purposes of this document, a Zamak alloy is defined as an alloy having 1-10% Al; 0-1% Cu; 0.01-1% Mg; less than 0.5% of impurities (impurities in this case being any element other than Al, Cu, Mg, and Zn); and the balance Zn. Specifically, the ASTM B240 standard defines the formula for ingots of the different members of the Zamak family. Some members of the Zamak family, as defined in ASTM B240, are Zamak 2, KS, Zamak 3, Zamak 4, Zamak 5, and Zamak 7. Any particular member of the Zamak family may be used herein. In an embodiment, Zamak 3 is used. The composition and properties of Zamak 3 are provided below. The composition of the other member of the Zamak family can found in the ASTM B240 standard, which is hereby incorporated herein by reference.

Zamak 3 composition per standard

| | | Alloying elements | | | Impurities | | | | | | | |
|---|---|---|---|---|---|---|---|---|---|---|---|---|
| Standard | Limit | Al | Cu† | Mg | Pb | Cd | Sn | Fe | Ni | Si | In | Tl |
| ASTM B240 | min | 3.9 | — | 0.025 | — | — | — | — | — | — | — | — |
| (Ingot) | max | 4.3 | 0.1 | 0.05 | 0.004 | 0.003 | 0.002 | 0.035 | — | — | — | — |

†Impurity

Zamak 3 properties

| Property | Metric value | Imperial value |
|---|---|---|
| Mechanical properties | | |
| Ultimate tensile strength | 268 MPa | 38,900 psi |
| Yield strength (0.2% offset) | 208 MPa | 30,200 psi |
| Impact strength | 46 J (56 J aged) | 34 ft-lbf (41 ft-lbf aged) |
| Elongation at $F_{max}$ | 3% | |
| Elongation at fracture | 6.3% (16% aged) | |
| Shear strength | 214 MPa | 31,000 psi |
| Compressive yield strength | 414 MPa | 60,000 psi |
| Fatigue strength (reverse bending $5 \times 10^8$ cycles) | 48 MPa | 7,000 psi |
| Hardness | 97 Brinell | |
| Modulus of elasticity | 96 GPa | 14,000,000 psi |
| Physical properties | | |
| Solidification range (melting range) | 381-387° C. | 718-729° F. |
| Density | 6.7 g/cm$^3$ | 0.24 lb/in$^3$ |
| Coefficient of thermal expansion | 27.4 μm/m-° C. | 15.2 μin/in-° F. |
| Thermal conductivity | 113 W/mK | 784 BTU-in/hr-ft$^2$-° F. |
| Electrical resistivity | 6.37 μΩ-cm at 20° C. | 2.51 μΩ-in at 68° F. |
| Latent heat (heat of fusion) | 110 J/g | $4.7 \times 10^{-5}$ BTU/lb |
| Specific heat capacity | 419 J/kg-° C. | 0.100 BTU/lb-° F. |
| Coefficient of friction | 0.07 | |

In the method, one or more spent fuel assemblies are removed from the sodium coolant pool and placed in a protective sheath. The remaining volume of the sheath is then filled with liquid Zamak. To a certain extent Zamak will dissolve and alloy with sodium remaining on the fuel assemblies. Excess sodium that remains undissolved is displaced from the sheath by the Zamak fill. The Zamak is then cooled until solid and the sheath sealed. The resulting Zamak-stabilized spent fuel assembly is calculated to have sufficient internal thermal conductivity to allow it to be stored and transported without the need for liquid cooling.

FIG. 1 illustrates an embodiment of an integrated energy system 100 with a sodium-cooled reactor 102. The sodium-cooled reactor 102 includes a reactor vessel 104 that contains a pool of sodium 106. One or more fuel assemblies 108 (three are illustrated) containing nuclear fuel are submerged in the pool of sodium 106. When immersed in the sodium 106, the inner chambers of the fuel assemblies 108 are filled with sodium. The sodium 106 acts as a primary coolant and during operation transfers heat from the immersed fuel assemblies 108 to the secondary coolant. Fuel assemblies are described in greater detail with respect to FIGS. 3 and 4.

In one design, as illustrated in FIG. 1, sodium in the pool circulates between the fuel assemblies 108 and a submerged, in-pool, heat exchanger referred to as the primary heat exchanger 110. A circulation loop (illustrated by liquid flow direction arrows 111) is formed in which heated sodium flows from the fuel assemblies 108 to the primary heat exchanger 110 and cooled sodium flows back to the fuel assemblies 108.

The primary heat exchanger 110 cools the sodium by transferring heat into the secondary coolant. The secondary coolant, which may be sodium or some other fluid coolant, circulates between the primary heat exchanger 110 and secondary heat exchanger 112. In the embodiment shown, the secondary heat exchanger 112 transfers heat from the secondary coolant to a thermal storage medium. A supply of cold medium is provided in a cold reservoir 114. The secondary heat exchanger 112 transfers heat to cold medium and the now hot medium is stored in a hot reservoir 116.

Thermal storage is well-known and any suitable thermal storage medium, now known or later developed, may be used. In the embodiment shown, the thermal storage medium is a salt. Examples of suitable thermal storage media include eutectic solutions, phase-change materials, miscibility gap alloys, mixtures of metals (e.g., $AlSi_{12}$), cement-based materials, molten salt (e.g., one or more chloride salts of sodium, potassium, and calcium; one or more nitrate salts of sodium, potassium, and calcium, NaKMg, or NaKMg—Cl, among others), solid or molten silicon, or combinations of these or other materials.

When power is needed from the integrated energy system 100, hot salt from the hot reservoir 116 is passed through a steam generator 118. In the steam generator 118, heat is transferred from the hot salt to a pressurized water stream to generate superheated steam. The (now cold) salt is passed to the cold reservoir 114 for storage until needed to receive more heat from the secondary coolant.

The heat energy in the superheated steam is converted to mechanical energy by passing the superheated steam through a conventional steam turbine and condenser system 120. In the embodiment shown, the steam turbine 122 drives an electrical generator 124 to create electricity.

In the embodiment shown, the reactor vessel 104 is capped by a vessel head 126. The vessel head 126 is provided with access ports to allow the insertion and removal of fuel assemblies from the reactor vessel 104. A fuel assembly handling system 130 is provided to retrieve fresh fuel assemblies from fuel assembly storage 132, insert and remove fuel assembles 108 from the reactor 102, and to transport spent fuel assemblies 108 to a Zamak Stabilization System 140. The fuel assembly handling system 130 maintains fuel assemblies in an inert environment during handling to prevent exposure of the fuel assemblies to water, air or any other undesired environment, thereby inhibiting, if not preventing, the formation of an oxide layer on the surfaces of the fuel assemblies during transport between the reactor vessel 104 and the Zamak Stabilization System 140. In an embodiment, the fuel assembly handling system 130 maintains fuel assemblies in a sodium environment during transport. In an alternative embodiment, fuel assemblies are maintained in an inert atmosphere, such as argon or nitrogen, during handling. In yet another embodiment, the fuel assembly handling system 130 maintains fuel assemblies in a reduced-oxygen environment having less than 0.1% oxygen, less than 0.01% oxygen or less than 0.001% oxygen.

The Zamak Stabilization System 140 receives spent fuel assemblies from the handling system 130. The system 140 may be implemented to receive spent fuel assemblies one or more at a time. Likewise, it may implemented to process the fuel assemblies one at a time or simultaneously in batches or two or more. After receiving a spent fuel assembly, the Zamak Stabilization System 140 places it in a protective sheath. As discussed in greater detail below, any open volumes within the fuel assembly 108 and the remaining volume of the sheath around the fuel assembly 108 are filled with liquid Zamak. Excess sodium that remains undissolved is displaced from the sheath by the Zamak fill and is collected by the Zamak Stabilization System 140 and may be reused in the reactor 102 or elsewhere in the integrated energy system 100. The Zamak Stabilization System 140 may then actively cool the sheathed spent fuel assembly until the Zamak is solid. The Zamak Stabilization System 140 also seals the sheath (either before, during, or after cooling). The resulting sheathed and Zamak-stabilized spent fuel assembly is calculated to have sufficient internal thermal conductivity to allow it to be stored and transported without the need for liquid cooling. In an embodiment, the Zamak Stabilization System 140 maintains the spent fuel assemblies in an inert environment during the stabilization process.

Figure 2:
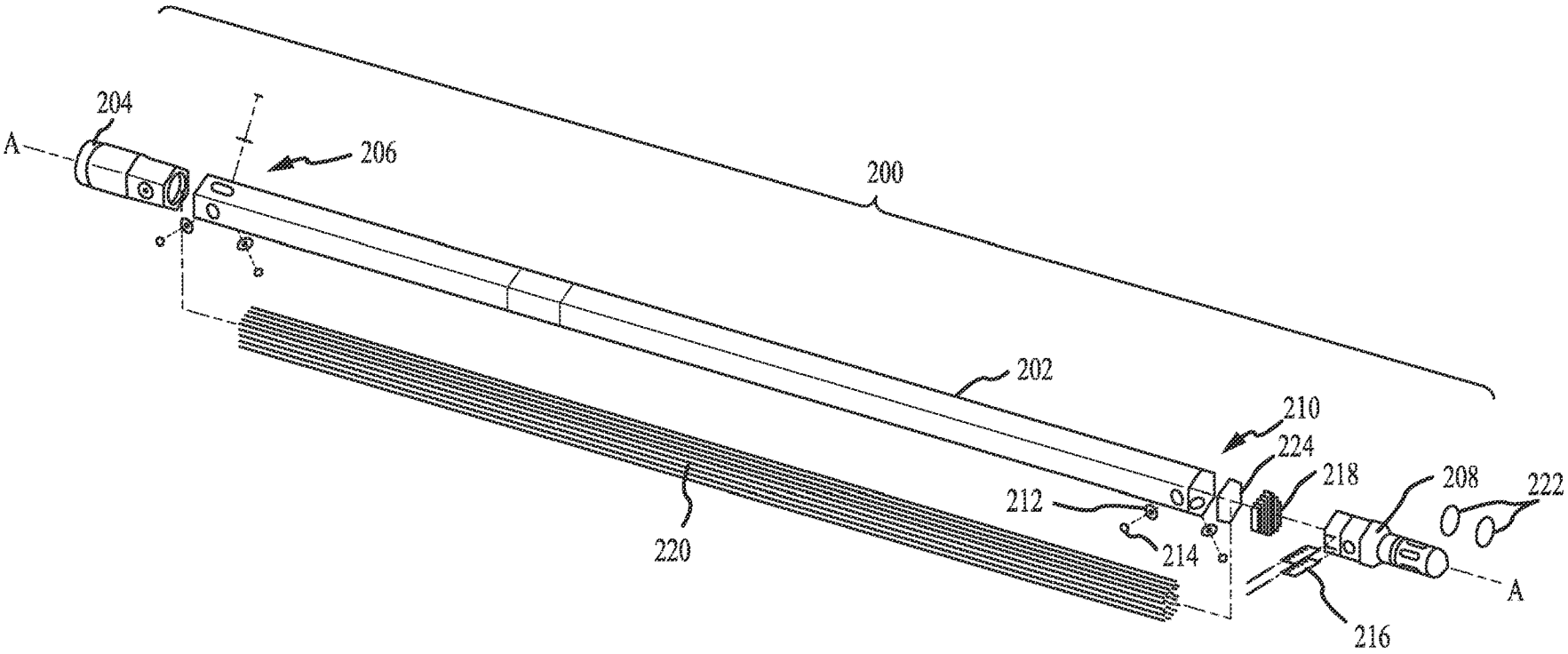
FIG. 2 is an exploded view of a fuel assembly for use in a sodium-cooled reactor.

FIG. 2 is an exploded view of an embodiment of a fuel assembly 200 for use in a traveling wave reactor or other sodium-cooled reactor. The assembly 200 includes an elongated coolant channel 202 having an axis A. The channel 202 has a hexagonal cross section. A handling socket 204 with an internal flow passage is secured to a first end 206 of the channel 202 and has internal or external features that allow it to be grasped by mechanisms within the reactor vessel to lift, lower, and otherwise move the assembly 200 into, out of, or within the core. An inlet nozzle 208 is secured to a second end 210 of the channel 202. A plurality of bearing rings 212 and retaining rings 214 are used to attach the handling socket 204 and inlet nozzle 208 to the channel 202. A plurality of lock plates 216 (two in this example) and a plurality of rod strip rails 218 are included proximate an end of the inlet nozzle 208. Together, the lock plates 216 and rod strip rails 218 connect the fuel rod bundle 220 to the inlet nozzle 208. In an embodiment, all of the fuel rods in the fuel rod bundle 220 are annular metal fuel rods as described above. In an alternative embodiment, only some of the fuel rods may be annular metal fuel rods with the other rods being of a different type or construction. Seal rings 222 and a flow restrictor 224 are also depicted.

Figure 3:
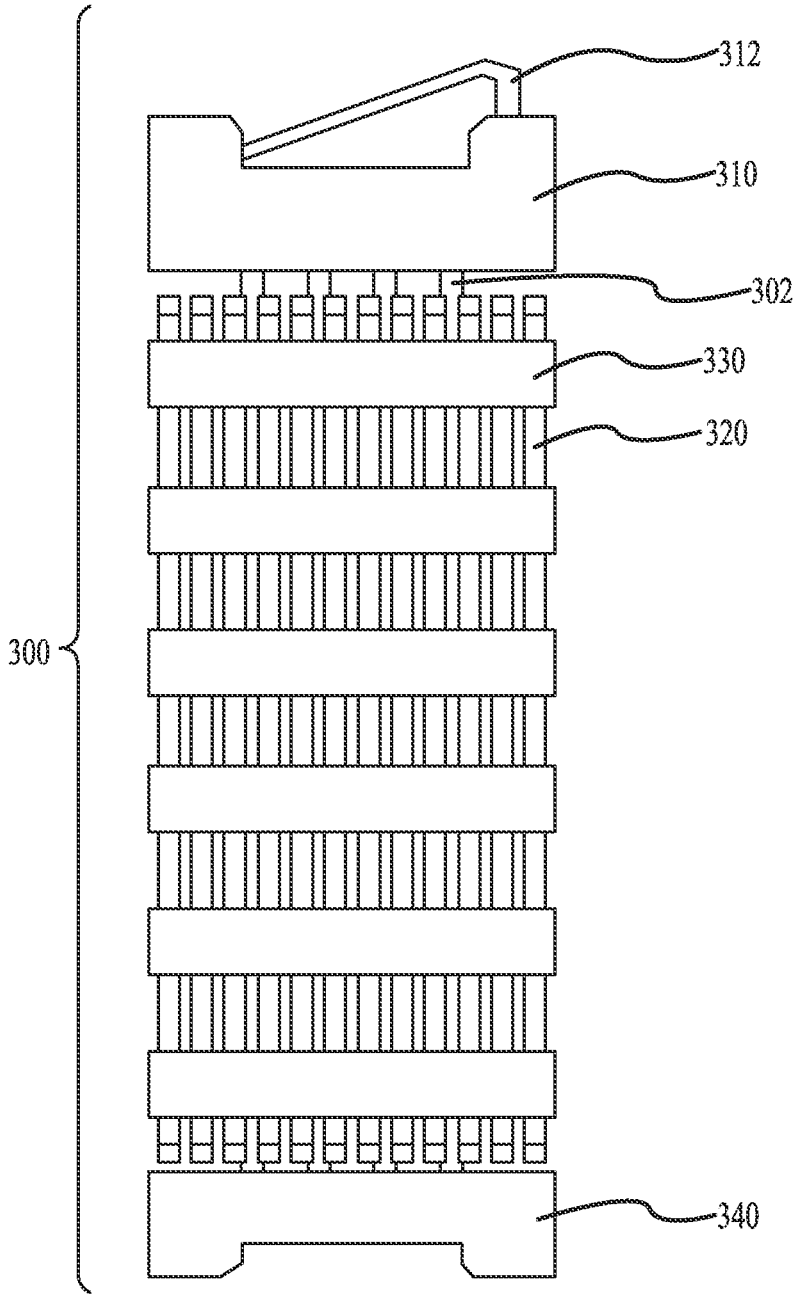
FIG. 3 illustrates a side view of a different type of fuel assembly.

FIG. 3 illustrates a side view of an alternative design for a fuel assembly 300. The assembly includes a set of fuel rods 320 penetrating and held in place by a number (six are shown) of spacer grids 330. A bottom nozzle assembly 340 supports the fuel assembly 300 within the core of the reactor. A top nozzle assembly 310 is provided at the top of the assembly 300 including a number of guide thimble tubes 302. The guide thimble tubes 302 extend from the top nozzle assembly 310 to the bottom nozzle assembly 340. The spacer grids 330 may be attached to the guide thimble tubes 302 for stability. A holddown spring 312 is provided above the top nozzle assembly 310 at the top of the assembly 300 to ensure the proper amount of holddown force on the fuel assembly's components.

It should be noted that the fuel rods described above need not be uniform along their length. For example regions of greater or lesser enrichment could be provided along the length of the fuel rod. This could be achieved by providing different annular slugs of fuel or different particulate fuel in the different regions during assembly. Likewise, specific regions could be provided with burnable poisons, other additives, or different types of metal fuels. In addition to different materials, different regions could be provided with different attributes such as different porosities, bulk densities, or different annular slug sizes even if the metal fuel material remains the same.

The fuel assemblies of FIGS. 2 and 3 are but two examples of a fuel assembly that could be stabilized using the methods and systems described herein. Many other fuel assembly designs exist for use in other types of reactors. The arrangement of fuel rods and other types of rods (control rods, reflectors, and instrumentation rods, for example) within a particular assembly for a particular reactor does not affect the Zamak stabilization techniques. The shape and arrangement of rods within an assembly as well as the shape, orientation, and arrangement of assemblies in a reactor core may differ as appropriate for the particular reactor design and as well as the number, type and performance of the annular metal fuel rods used without effect on stabilization process.

Figure 4:
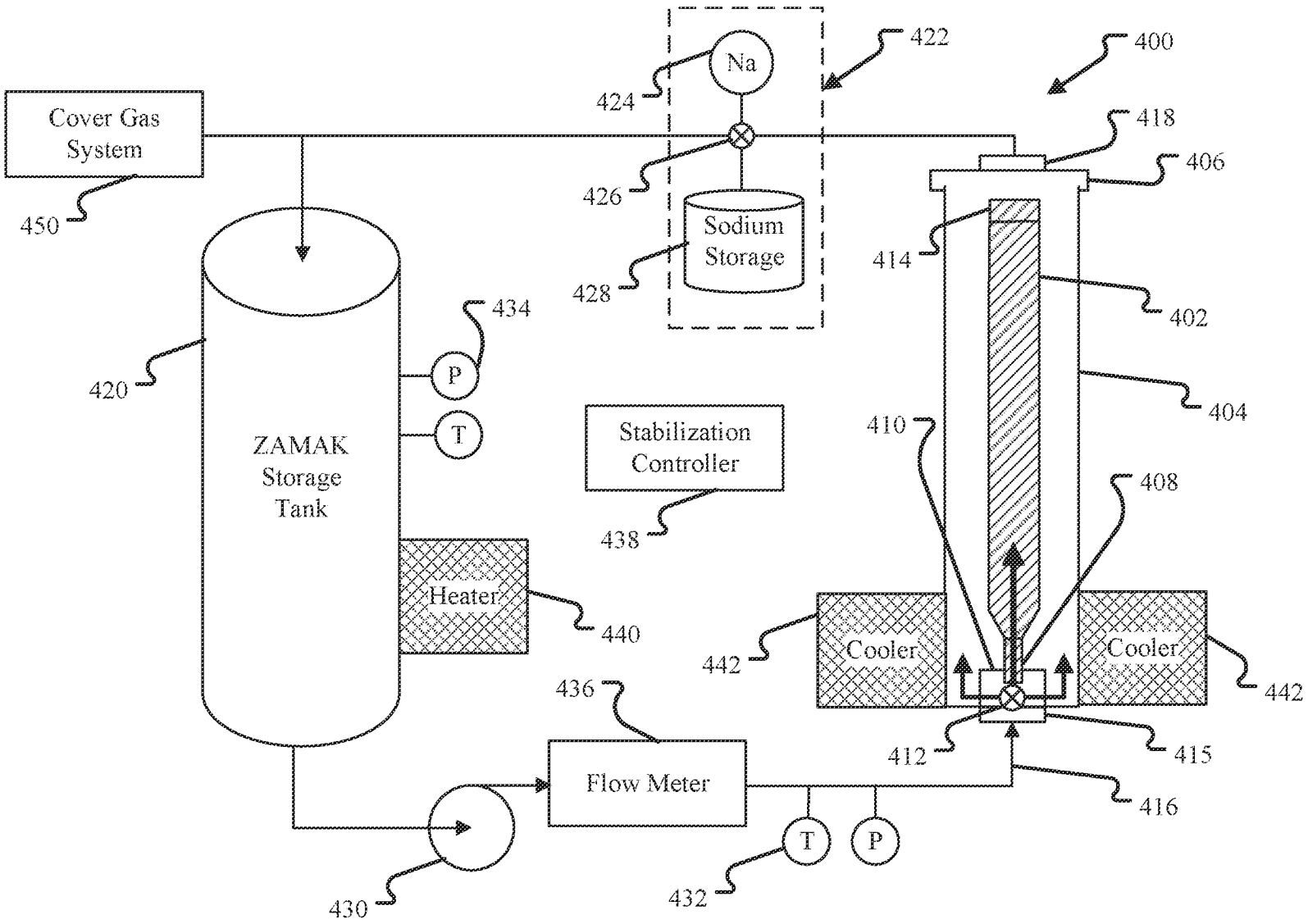
FIG. 4 illustrates an embodiment of a Zamak Stabilization System suitable for use in the integrated energy system illustrated in FIG. 1.

FIG. 4 illustrates an embodiment of a Zamak Stabilization System suitable for use in the integrated energy system illustrated in FIG. 1. In the embodiment shown, a spent fuel assembly 402 when received by the Zamak Stabilization System 400 is placed into a sheath 404 and the sheath then capped with an end cap 406. The sheath 404 is provided with a receptacle 410 to engage the bottom nozzle 408 of the fuel assembly 402. Additional supports (not shown) may be provided within the sheath to guide placement of the fuel assembly or provide further support within the sheath prior to Zamak filling. In an embodiment, the receptacle 410 both supports the fuel assembly 402 and allows Zamak to be injected into the fuel assembly 402 via the bottom nozzle 408 prior to the general filling of the sheath 404 with Zamak. The receptacle 410 is connected at the bottom of the sheath to a lower access port 415 through which Zamak is delivered by a pipe 416.

The sheath 404 may be made of any suitable structural material. The sheath material must have a melting point higher than that of Zamak and should maintain a suitable amount of strength at the Zamak operating temperature. Zamak's melting point is approximately 380-390° C. In an embodiment, the Zamak is delivered at a temperature of 400-450° C. when filling the fuel assembly and/or sheath chamber. In an alternative embodiment, the Zamak temperature at delivery is anywhere from 380-2,000° C.

Suitable materials for the sheath 404, as well as other components in the Zamak flow loop, include any suitable steel such as, in particular, stainless steels like 304 steel, 316 steel, ferritic martensitic steels, such as T-91 or other non-corrosive materials with suitable melting points and strength. Further examples of suitable steels include a martensitic steel, a ferritic steel, an austenitic steel, stainless steels including aluminum-containing stainless steels, advanced steels such as FeCrAl alloys, HT9, oxide-dispersion strengthened steel, T91 steel, T92 steel, HT9 steel, 316 steel, 304 steel, an APMT (Fe-22 wt. % Cr-5.8 wt. % Al) and Alloy 33 (a mixture of iron, chromium, and nickel, nominally 32 wt. % Fe-33 wt. % Cr-31 wt. % Ni). Unless otherwise specified, all percentages (%) herein are weight percentages (wt. %). The steel may have any type of microstructure. For example, in an embodiment substantially all the steel in the cladding 106 has at least one phase chosen from a tempered martensite phase, a ferrite phase, and an austenitic phase. In an embodiment, the steel is an HT9 steel or a modified version of HT9 steel.

A controllable valve 412 is provided that controls whether Zamak is directing into the bottom nozzle 408 or into the volume between the sheath and the exterior surfaces of the spent fuel assembly. This allows the internal volumes of the fuel assembly accessible via the bottom and top nozzles to be filled independently of the filling of the external volume between the sheath 404 and the exterior surfaces of the spent fuel assembly 402. Both volumes may be filled simultaneous or filling may be staggered. In the embodiment shown, the valve 412 is in the sheath 404. In an alternative embodiment, the valve 412 may be external to the sheath 404 allowing the valve 412 reused. In this embodiment, the sheath will have at least two access ports, one for filling of the external volume between the sheath 404 and the exterior surfaces of the spent fuel assembly 402 and one for the filling of internal volumes of the fuel assembly 402 accessible via the bottom nozzle 408 and top nozzle 414.

When filling the internal volumes of the fuel assembly 402, any excess sodium that does not alloy with the Zamak will be displaced by the heavier Zamak and ultimately be pushed out of the top nozzle 414 into the sheath chamber (i.e., the volume between the sheath 404 and the exterior surfaces of the spent fuel assembly 402). When the sheath chamber is filled, any excess sodium will likewise be displaced and will ultimately be pushed out of the sheath, through an access port 418 in the sheath cap 406. The access port 418 in the sheath cap 406 is connected to a Zamak storage tank 420.

Between the access port 418 and the Zamak storage tank 420 is shown a sodium trap 422. In the embodiment shown, the sodium trap includes a sodium sensor 424, a controllable valve 426 and a sodium storage tank 428. When sodium is detected in the pipe, the valve directs the sodium into the sodium storage tank 428. When Zamak is detected, the Zamak is directed by the valve 426 to the Zamak storage tank 420. The sodium trap 422 is but one possible way of collecting the excess sodium from the sheath. Many other sodium trap designs or strategies could be used to achieve the same result and any such suitable design or strategy could be utilized here.

The flow of Zamak through the Zamak loop is driven by a pump 430. Additional components include sensors such as temperature sensors 432 and pressure sensors 434. Such sensors can be placed throughout the system 400. In the embodiment shown, sensors are provided both on the Zamak storage tank 420 and the delivery pipe 416 just before the access port 415. A flow meter 436 is shown that allows the flow and volume of Zamak delivered to the sheath to be monitored.

A controller 438 is provided to control the process and operation of the different components. It is communicatively connected to the sensors, controllable valves, pump 430 and other components in order to receive data and transmit commands to the different components based on the processing of the data received.

After the sheath and spent fuel assembly are filled with Zamak, the sheath is sealed and removed from the loop. In an embodiment, the attaching pipes at the bottom and top are cut and blinded off or sealed in any suitable fashion. However, this is but one technique and any suitable alternative sealing and removal technique could be used.

Another component illustrated is a heater 440 for heating the Zamak in the storage tank 420 and maintaining it in a liquid state during the stabilization process. In an embodiment the heater 440 could take the form of a resistive jacket heater around the exterior of the storage tank 420.

Another component illustrated is a sheath cooler 442 for cooling the sheath 404 after filling it with Zamak. In an embodiment the cooler 442 could take any suitable form including a cooling jacket or a fan that directs room temperature air on the exterior of the sheath. In yet another alternative, a temperature-controlled room could be provided as the cooler 442. After the sheath is filled, sealed, and removed from the loop, the sheath could be placed in the temperature-controlled room. The cooling of the Zamak could then be controlled precisely. In an embodiment, the cooler is located as illustrated to cool the bottom of the sheath 404 so that the Zamak solidifies from the bottom up.

Another component of the system 400 is the cover gas control system 450. The cover gas system 450 maintains a cover gas environment within the loop, when the loop is not completely filled with Zamak. For example, when the fuel assembly 402 is first placed into the into the sheath 404, the cover gas system 450 controls the environment around the fuel assembly to reduce the exposure of the fuel assembly 402 to oxygen in order to inhibit if not prevent the formation of an oxide layer surfaces on the fuel assembly. Cover gas systems are known in the art and any suitable configuration for the system 450 may be used to reduce the exposure of the fuel assembly to oxygen before and during the Zamak filling process.

Figure 5:
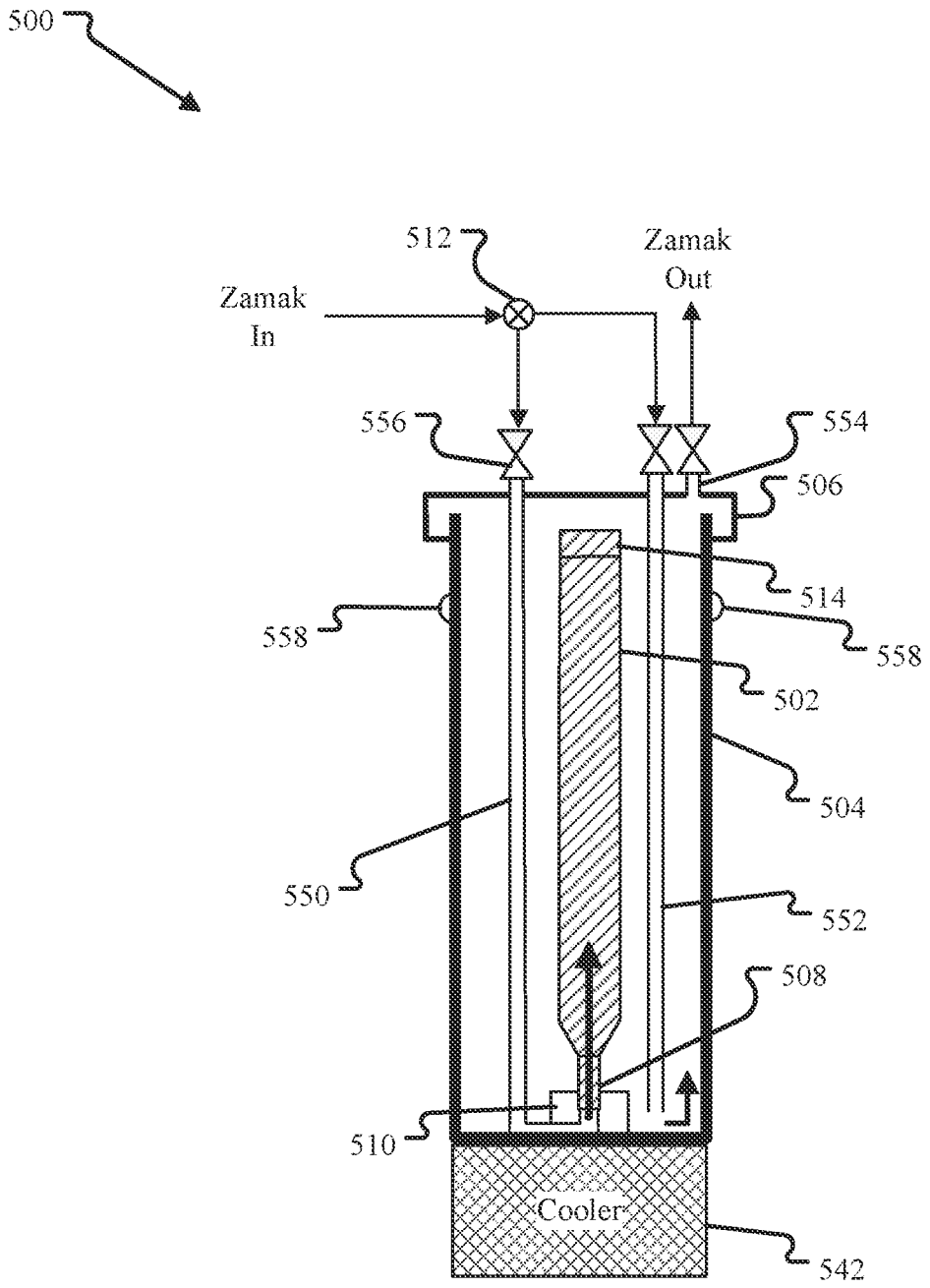
FIG. 5 illustrates an alternative embodiment of a sheath including additional features that could be implemented on any sheath embodiment.

FIG. 5 illustrates an alternative embodiment of a sheath 500 showing additional features that could be implemented on any sheath embodiment.

In the embodiment shown, the sheath 504 and cap 506 are designed so that the sheath 504 is a unitary vessel having only the top opening which is capped by the cap 506. This allows the sheath to be easily made and reduces complexity. The sheath 504 is provided with a receptacle 510 to engage the bottom nozzle 508 of the fuel assembly 502.

In order to still perform the Zamak filling from the bottom, two dip tubes 550 and 552 are provided. A fuel assembly dip tube 550 is fluidically connected to the receptacle 510 so that Zamak flowing through the dip tube 550 enters the fuel assembly 502 through the bottom nozzle 508. A second dip tube 552 is provided to fill the annulus region between the fuel assembly and sheath. In an alternative embodiment this second dip tube is omitted and the annulus region is filled by overflowing Zamak out of the top nozzle 514 of the fuel assembly 502. A further control valve 512 on the Zamak inlet line may be provided to control/distribute flow between the two dip tubes 550, 552. The dip tubes 550, 552 may be built into the cap so that when the cap 506 and sheath 504 are connected the dip tubes are properly located. Alternatively, the dip tubes 550, 552 may be built into the sheath 504 and the appropriate corresponding apertures are provided in the cap 506.

The cap 506 is further provided with an outlet 554 through which excess sodium and Zamak will be displaced when the sheath 504 is filled. Each dip tube 550, 552 and the outlet 554 may be provided with connecting valves 556 that can be closed after filling.

The sheath 504 can be easily cooled from the bottom using a cooler 542 connected to the bottom exterior of the sheath 504, which no longer has any fitting or connections to work around.

In the embodiment shown, the exterior of the sheath 504 is provided with two eyes 558 for lifting and handling of the sheath 504 before, during and after filling.

Figure 6:
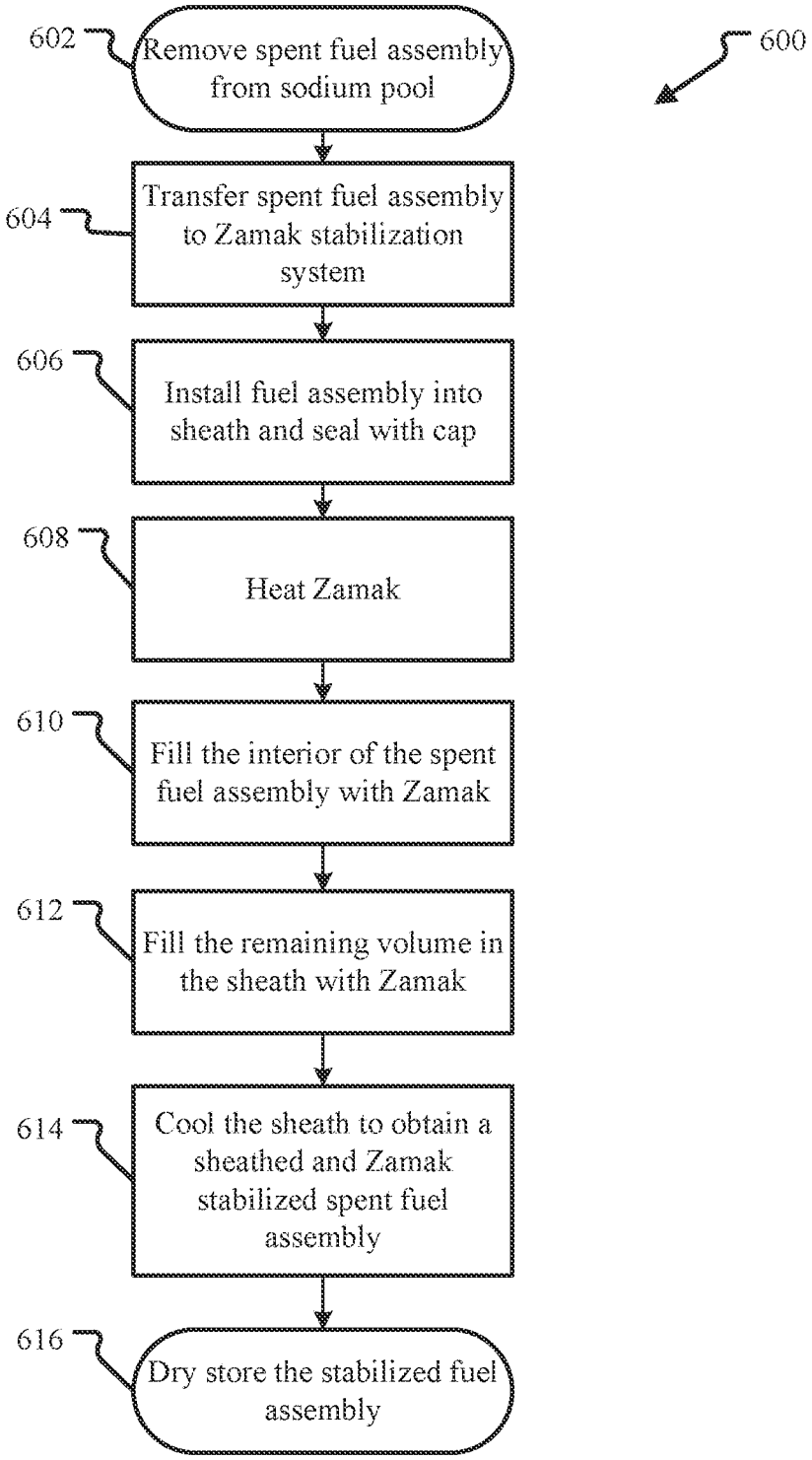
FIG. 6 illustrates an embodiment of a method for stabilizing a spent nuclear fuel assembly from a sodium-cooled reactor using Zamak.

FIG. 6 illustrates an embodiment of a method for stabilizing a spent nuclear fuel assembly from a sodium-cooled reactor using Zamak. In the embodiment shown, the method begins with removing a spent fuel assembly from a sodium-cooled reactor in a removal operation 602. The removal operation 602 may include accessing the spent fuel assembly in a pool of sodium within the reactor vessel and removing it using a fuel assembly handling system. As discussed in greater detail below, during transport the fuel assembly is maintained in a controlled environment of less than 0.1% oxygen thereby reducing the formation of an oxide layer on the surfaces of the fuel assemblies between the removal of the fuel assembly from the pool in this removal operation 602 and the completion of the Zamak filling operations in the second filling operation 612.

The spent fuel assembly is then delivered to a Zamak stabilization system in a delivery operation 604.

Upon receiving the spent fuel assembly, it is placed in a sheath in a sheathing operation 606. In an embodiment of the sheathing operation 606, the bottom nozzle of the fuel assembly is engaged with a receptacle at the bottom of the sheath and the sheath is capped. The now-sealed sheath is then connected to the Zamak piping.

If the Zamak is not already heated to its liquid operating temperature, liquid Zamak is generated by heating a quantity of Zamak to a temperature above its melting point in a Zamak generating operation 608.

A first filling operation 610 is performed in which the interior chamber(s) of the spent nuclear fuel assembly is filled with liquid Zamak by flowing liquid Zamak through the receptacle of the sheath and the bottom nozzle of the fuel assembly. Any excess sodium will be displaced from the top nozzle of the fuel assembly. The sodium may be collected from the top nozzle or may be allowed to pool in the annular volume between the exterior of the fuel assembly and the sheath, if that region has not yet been filled with Zamak.

A second filling operation 612 is also performed in which the annular volume between the exterior surfaces of the fuel assembly and the sheath is filled with Zamak. Again, any excess sodium on the exterior surfaces of the fuel assembly will be displaced and will float on the surface of the Zamak as the volume is filled. In an embodiment, the annular volume between the exterior surfaces of the fuel assembly and the sheath may be filled through a sheath access port in the bottom of the sheath. Alternatively, the annular volume between the exterior surfaces of the fuel assembly and the sheath may be filled by passing additional Zamak through the fuel assembly and allowing the excess Zamak to overflow out of the top nozzle of the fuel assembly until the annular volume is filled. The second filling operation 612 may be performed until all the excess sodium is displaced from the sheath and Zamak is flowing out of the sheath. Any excess sodium displaced from the sheath may be collected and stored for later cleaning and/or reuse in the reactor pool.

In an embodiment, an excess volume of Zamak may be flowed either through the sheath or the fuel assembly after filling to provide an additional Zamak flush of the filled component. The amount of excess amount of Zamak flowed through a volume may be determined based on the size of the volume, which will be known. Alternative, the Zamak flush may be performed based on time after initial filling (e.g., running Zamak through the sheath for 10 minutes after the sheath is filled in order to reduce any unfilled regions or displace any remaining sodium).

In yet another embodiment, no excess sodium or Zamak is removed from the sheath. Rather, the sheath is only filled to the point where the fuel assembly is partially or completely submerged in Zamak and then sealed. In this embodiment, all sodium from the reactor remains in the sheath and is disposed of with the final stabilized fuel assembly. This embodiment may be wasteful of sodium, but reduces the amount of handling of irradiated sodium.

In an embodiment, flow of the Zamak into bottom nozzle the fuel assembly and sheath can be independently controlled. This allows the first and second filling operations 610 and 612 to done in any order. For example, in an embodiment, the first filling operation 610 is done first, and only after the fuel assembly has been filled is the second filling operation 612 is performed. The first and second filling operations 610 and 612 may be aided by vibrating the sheath during the filling operations.

A cooling operation 614 is then performed on the Zamak filled sheath. As discussed above, the cooling may be done actively or passively. In an embodiment, a cooler is used to cool the sheath from below so that the lowest portions of Zamak solidify first. The rate of cooling may be controlled. The Zamak is cooled to below its melting point and may be further cooled to room temperature.

Once cooled, the sheathed and Zamak stabilized fuel assembly is ready for dry storage illustrated by the dry storing operation 616. This may include placing the sheathed and Zamak stabilized fuel assembly outside, in a building, or in a subterranean borehole or other chamber. The sheathed and Zamak stabilized fuel assembly may be further placed in a cask, frame, or other container to assist in transport or storage.

One or either of the removal operation 602 and the delivery operation 604 may include a draining operation in which liquid sodium is allowed to drain from the spent nuclear fuel assembly. This will reduce or even eliminate the amount of excess sodium that is recovered when filling the sheath.

In an embodiment of the stabilization method 600, all of the operations of the method are performed without exposing the spent fuel assembly to an environment have more than 0.1% oxygen in order to prevent the formation of oxides on a surface of the fuel assembly. This may be done by maintaining the spent fuel assembly in an inert atmosphere (i.e., an atmosphere of one or more inert gases such as argon, nitrogen, and helium having less than 0.1 wt. % oxygen), a reduced-oxygen atmosphere (for example, less than 0.1 wt. % oxygen, less than 0.01 wt. % oxygen) or within a sodium environment while handling the spent fuel assembly. In an alternative embodiment, the removal and delivery operations 604 and 606 may be performed quickly, relying on the sodium wetting of the spent fuel to prevent any substantial formation of oxides. If the filling operations are performed with the interior of the sheath in an inert or sodium environment, the displaced inert material or sodium may be collected for reuse.

In an alternative embodiment of the method 600, the sheath is omitted. In this embodiment, the spent fuel assembly is filled with Zamak, the nozzles are sealed, and the Zamak is cooled to obtain a Zamak stabilized, but unsheathed, spent fuel assembly. In an embodiment, this simpler approach may be sufficient if the decay heat generation is minimal.

Although described in the context of disposing of spent fuel assemblies, the systems and methods described above could be used to stabilize new fuel assemblies or any other components that have been exposed to sodium, whether or not containing nuclear material that generates decay heat. For example, in an embodiment the systems and methods described above could be used to dispose of a metal component such as a tube that has held sodium or been in a sodium environment. The Zamak stabilization system could be used to fill the tube with Zamak, thus displacing any residual sodium in the tube, and the stabilized tube could then be cooled to create a Zamak-stabilized tube ready for storage and/or disposal.

Notwithstanding the appended claims, the disclosure is also defined by the following numbered clauses:

1. A method for preparing a spent nuclear fuel assembly for storage, the spent nuclear fuel assembly having an exterior, one or more interior chambers accessible through a bottom nozzle and a top nozzle, the method comprising:

providing a quantity of Zamak, the Zamak having a first melting point;

providing a sheath made of a material having a second melting point greater than the first melting point and the sheath further provided with a receptacle configured to engage with the bottom nozzle of the spent nuclear fuel assembly;

removing the spent nuclear fuel assembly from a liquid sodium environment;

placing the spent nuclear fuel assembly in a sheath, thereby engaging the receptacle with the bottom nozzle;

generating liquid Zamak by heating the quantity of Zamak to a temperature above the first melting point but below the second melting point;

filling the one or more interior chambers of the spent nuclear fuel assembly with liquid Zamak by flowing liquid Zamak through the receptacle and bottom nozzle; and filling the sheath with liquid Zamak by flowing liquid Zamak into a volume between the sheath and the exterior of the spent nuclear fuel assembly until with the liquid Zamak.

2. The method of clause 1, wherein the Zamak is selected from Zamak 2, KS, Zamak 3, Zamak 4, Zamak 5, and Zamak 7.

3. The method of clause 1, wherein the Zamak is Zamak 3.

4. The method of any of clauses 1-3, further comprising:

after filling the sheath with liquid Zamak, cooling the Zamak in the sheath to a temperature below the first melting point.

5. The method of any of clauses 1-4, further comprising:

placing the spent nuclear fuel assembly in the sheath under an inert environment; and filling the sheath with liquid Zamak, thereby displacing the inert environment.

6. The method of any of clauses 1-5, wherein the material having a second melting point greater than the first melting point is selected from 304 stainless steel, 316 stainless steel, and T91 steel.

7. The method of any of clauses 1-6, further comprising:

draining liquid sodium from the spent nuclear fuel assembly.

8. The method of any of clauses 1-7, further comprising:

collecting sodium displaced from the sheath and the one or more interior chambers by the filling operations.

9. The method of any of clauses 1-8, wherein the placing operation further comprises:

capping the sheath after placing the spent nuclear fuel assembly in the sheath.

10. The method of any of clauses 1-8, further comprising:

after filling the sheath and the one or more interior chambers with Zamak, cooling the sheath.

11. The method of clause 10, wherein the cooling operation further comprises:

cooling the sheath from the bottom.

12. The method of any of clauses 1-11, further comprising:

after filling the sheath and the one or more interior chambers with Zamak, placing the sheath in dry storage.

13. The method of any of clauses 1-11, further comprising:

after filling the sheath and the one or more interior chambers with Zamak, placing the sheath in a dry, subterranean storage location.

14. The method of any of clauses 1-13, further comprising:

preventing the formation of an oxide on at least one surface of the spent nuclear fuel assembly between the removing of the spent nuclear fuel assembly from the sodium environment and the filling of the spent nuclear fuel assembly with liquid Zamak.

15. The method of any of clauses 1-13, further comprising:

maintaining the spent nuclear fuel assembly in a reduced-oxygen environment, thereby inhibiting the formation of an oxide layer on surfaces of the spent nuclear fuel assembly.

16. The method of any of clauses 1-13, wherein one or more operations of the method are performed in one of an inert atmosphere or a reduced-oxygen atmosphere, thereby inhibiting the formation of an oxide layer on surfaces of the spent nuclear fuel assembly.

17. A method for preparing a spent nuclear fuel assembly for storage comprising:

providing a quantity of Zamak, the Zamak having a first melting point;

removing the spent nuclear fuel assembly from a liquid sodium environment while controlling the exposure of the spent nuclear fuel assembly to oxygen, thereby inhibiting formation of an oxide layer on the spent nuclear fuel assembly;

filling the spent nuclear fuel assembly with the liquid Zamak to obtain a Zamak-filled spent nuclear fuel assembly;

cooling the Zamak-filled spent nuclear fuel assembly until the Zamak is at a temperature below the first melting point to obtain a Zamak-stabilized spent nuclear fuel assembly; and dry storing the Zamak-stabilized spent nuclear fuel assembly.

18. The method of clause 17, wherein the filling operation further comprises:

placing the spent nuclear fuel assembly in a sheath, the sheath made of a material having a second melting point greater than the first melting point; and filling both the sheath and spent nuclear fuel assembly with liquid Zamak.

19. The method of either clause 17 or 18, wherein the Zamak is selected from Zamak 2, KS, Zamak 3, Zamak 4, Zamak 5, and Zamak 7.

20. The method of either clause 17 or 18, wherein the Zamak is Zamak 3.

21. The method of any of clauses 17-20, further comprising:

after filling the sheath with liquid Zamak, cooling the Zamak in the sheath to a temperature below the first melting point.

22. The method of any of clauses 17-21, further comprising:

placing the spent nuclear fuel assembly in the sheath under an inert environment; and filling the sheath with liquid Zamak, thereby displacing the inert environment.

23. The method of any of clauses 17-22, wherein the material having a second melting point greater than the first melting point is selected from 304 stainless steel, 316 stainless steel, and T91 steel.

24. The method of any of clauses 17-23, further comprising:

draining liquid sodium from the spent nuclear fuel assembly.

25. The method of any of clauses 17-24, further comprising:

collecting sodium displaced from the sheath and the spent nuclear fuel assembly by the filling operations.

26. The method of any of clauses 17-25, wherein the placing operation further comprises:

capping the sheath after placing the spent nuclear fuel assembly in the sheath.

27. The method of any of clauses 17-26, further comprising:

after filling the sheath and the one or more interior chambers with Zamak, cooling the sheath.

28. The method of clause 27, wherein the cooling operation further comprises:

cooling the sheath from the bottom.

29. The method of any of clauses 17-28, further comprising:

after filling the sheath and the spent nuclear fuel assembly with Zamak, placing the sheath in dry storage.

30. The method of any of clauses 17-28, further comprising:

after filling the sheath and the spent nuclear fuel assembly with Zamak, placing the sheath in a dry, subterranean storage location.

31. The method of any of clauses 17-30, wherein the method is performed without exposing the spent nuclear fuel assembly to oxygen.

32. The method of any of clauses 17-30, wherein one or more operations of the method are performed without exposing the spent nuclear fuel assembly to oxygen.

33. The method of any of clauses 17-32, wherein one or more operations of the method are performed in an inert atmosphere.

34. An apparatus comprising:

a fuel assembly filled with solid Zamak.

35. The apparatus of clause 34, wherein the fuel assembly is sealed within a container.

36. The apparatus of clause 35, wherein a volume between the fuel assembly and the container is filled with solid Zamak.

37. A system for stabilizing a spent nuclear fuel assembly from a sodium-cooled nuclear reactor comprising:

a Zamak storage tank;

a quantity of Zamak, the Zamak having a melting point;

a sheath configured to receive and sealingly retain the spent nuclear fuel assembly, the sheath having an inlet port for receiving liquid Zamak and injecting it into the sheath; and a heater adapted to heat Zamak above the melting point.

38. The system of clause 37 further comprising:

a controller configured to control a flow of liquid Zamak into the sheath.

39. The system of clause 37 further comprising:

a cooler adapted to cool the sheath and its contents to below the melting point.

40. The system of clause 37 further comprising:

a sodium trap configured to collect liquid sodium from the sheath.

41. The system of clause 37 further comprising:

the sodium-cooled nuclear reactor including a sodium pool containing fuel assemblies.

42. The system of clause 41 further comprising:
a fuel assembly handling system adapted to transfer fuel assemblies from the sodium pool to the sheath.
43. The system of any of clauses 37-42 further comprising:
a cover gas system adapted to maintain the spent nuclear fuel assembly in a reduced-oxygen environment.
44. The systems and methods of any of the clauses above wherein a component exposed to sodium is stabilized instead of a spent nuclear fuel assembly.
45. A method for preparing a component with a surface exposed to sodium for storage comprising:
providing a quantity of Zamak, the Zamak having a first melting point;
displacing sodium from the surface with liquid Zamak to obtain a Zamak-coated surface on the component; and
cooling the Zamak until the Zamak is at a temperature below the first melting point to obtain a Zamak-stabilized component.
46. The method of clause 45, wherein the component is a tube that was filled with sodium, wherein displacing further comprises:
filling the tube with liquid Zamak.
47. The systems and methods of any of the clauses above wherein the Zamak is an alloy having 1-10% Al; 0-1% Cu; 0.01-1% Mg; less than 0.5% of impurities (i.e., any element other than Al, Cu, Mg, and Zn); and the balance Zn.

Unless otherwise indicated, all numbers expressing quantities of ingredients, properties such as molecular weight, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained.

Notwithstanding that the numerical ranges and parameters setting forth the broad scope of the technology are approximations, the numerical values set forth in the specific examples are reported as precisely as possible. Any numerical value, however, inherently contain certain errors necessarily resulting from the standard deviation found in their respective testing measurements.

It will be clear that the systems and methods described herein are well adapted to attain the ends and advantages mentioned as well as those inherent therein. Those skilled in the art will recognize that the methods and systems within this specification may be implemented in many manners and as such are not to be limited by the foregoing exemplified embodiments and examples. In other words, functional elements being performed by a single or multiple components, in various combinations of hardware and software, and individual functions can be distributed among software applications at either the client or server level. In this regard, any number of the features of the different embodiments described herein may be combined into one single embodiment and alternate embodiments having fewer than or more than all of the features herein described are possible.

While various embodiments have been described for purposes of this disclosure, various changes and modifications may be made which are well within the scope contemplated by the present disclosure. For example, many alternative embodiments of the basic design shown in FIG. 1 will be immediately suggested to the reader. The secondary heat exchanger 112, for example, may be omitted and the thermal storage medium used as the secondary coolant. Eliminating the intermediate thermal loop simplifies construction, piping, valves, and reduces cost. Numerous other changes may be made which will readily suggest themselves to those skilled in the art and which are encompassed in the spirit of the disclosure.

What is claimed is:

1. A method for preparing a spent nuclear fuel assembly for storage comprising:
providing a quantity of Zamak, the Zamak having a first melting point;
removing the spent nuclear fuel assembly from a liquid sodium environment while controlling the exposure of the spent nuclear fuel assembly to oxygen, thereby inhibiting formation of an oxide layer on the spent nuclear fuel assembly;
while controlling the exposure of the spent nuclear fuel assembly to oxygen, filling the spent nuclear fuel assembly with the liquid Zamak to obtain a Zamak-filled spent nuclear fuel assembly, thereby dissolving at least some liquid sodium in the spent nuclear fuel assembly into the Zamak and displacing any remaining liquid sodium from the spent nuclear fuel assembly;
cooling the Zamak-filled spent nuclear fuel assembly until the Zamak is at a temperature below the first melting point to obtain a Zamak-stabilized spent nuclear fuel assembly; and
dry storing the Zamak-stabilized spent nuclear fuel assembly.

2. The method of claim 1, wherein the filling operation further comprises:
placing the spent nuclear fuel assembly in a sheath, the sheath made of a material having a second melting point greater than the first melting point; and
filling both the sheath and spent nuclear fuel assembly with liquid Zamak.

3. The method of claim 1, wherein the Zamak is selected from Zamak 2, KS, Zamak 3, Zamak 4, Zamak 5, and Zamak 7.

4. The method of claim 3, wherein the Zamak is Zamak 3.

5. The method of claim 2, further comprising:
after filling the sheath with liquid Zamak, cooling the Zamak in the sheath to a temperature below the first melting point.

6. The method of claim 2, further comprising:
placing the spent nuclear fuel assembly in the sheath under an inert environment; and
filling the sheath with liquid Zamak, thereby displacing the inert environment.

7. The method of claim 1, further comprising:
draining liquid sodium from the spent nuclear fuel assembly.

8. The method of claim 2, further comprising:
collecting sodium displaced from the sheath and the spent nuclear fuel assembly by the filling operations.

9. The method of claim 2, further comprising:
after filling the sheath and the spent nuclear fuel assembly with Zamak, cooling the sheath.

10. The method of claim 9, wherein the cooling operation further comprises:
cooling the sheath from the bottom.

11. The method of claim 2, further comprising:
after filling the sheath and the spent nuclear fuel assembly with Zamak, placing the sheath in dry storage.

12. The method of claim 2, further comprising:

after filling the sheath and the spent nuclear fuel assembly with Zamak, placing the sheath in a dry, subterranean storage location.

13. The method of claim 1, wherein controlling the exposure of the spent nuclear fuel assembly to oxygen comprises:

maintaining the spent nuclear fuel assembly in a reduced-oxygen environment having less than 0.01 wt. % oxygen until it is filled with Zamak.

14. The method of claim 1, wherein one or more operations of the method are performed without exposing the spent nuclear fuel assembly to oxygen.

15. The method of claim 1, wherein one or more operations of the method are performed in an inert atmosphere.

16. The method of claim 1, wherein the Zamak is an alloy having 1-10% Al;

0-1% Cu; 0.01-1% Mg; less than 0.5% of impurities (i.e., any element other than Al, Cu, Mg, and Zn); and the balance Zn.

17. The method of claim 2, wherein the placing operation further comprises:

capping the sheath after placing the spent nuclear fuel assembly in the sheath.

18. The method of claim 2, wherein the material having a second melting point greater than the first melting point is selected from 304 stainless steel, 316 stainless steel, and T91 steel.

19. A method for preparing a component with a surface exposed to sodium for storage comprising:

providing a quantity of Zamak, the Zamak having a first melting point;

displacing sodium from the surface with liquid Zamak to obtain a Zamak-coated surface on the component, thereby dissolving at least some sodium on the surface of the component into the Zamak and displacing any remaining sodium from the surface of the component; and cooling the Zamak until the Zamak is at a temperature below the first melting point to obtain a Zamak-stabilized component.

* * * * *